US011607785B2

(12) United States Patent
Tanaka

(10) Patent No.: US 11,607,785 B2
(45) Date of Patent: Mar. 21, 2023

(54) FASTENER-DRIVING TOOL

(71) Applicant: MAX CO., LTD., Tokyo (JP)

(72) Inventor: Hiroshi Tanaka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 137 days.

(21) Appl. No.: 16/975,352

(22) PCT Filed: Feb. 27, 2019

(86) PCT No.: PCT/JP2019/007714
§ 371 (c)(1),
(2) Date: Aug. 24, 2020

(87) PCT Pub. No.: WO2019/168077
PCT Pub. Date: Sep. 6, 2019

(65) Prior Publication Data

US 2020/0398413 A1 Dec. 24, 2020

(30) Foreign Application Priority Data

Mar. 1, 2018 (JP) ..... JP2018-036898

(51) Int. Cl.
*B25C 1/04* (2006.01)
*B25C 7/00* (2006.01)
(Continued)

(52) U.S. Cl.
CPC ..... *B25C 1/047* (2013.01); *B25C 7/00* (2013.01); *B25C 1/043* (2013.01); *B25C 1/06* (2013.01); *B25C 5/15* (2013.01)

(58) Field of Classification Search
CPC .. B25C 1/04; B25C 1/06; B25C 1/043; B25C 1/047; B25C 5/13; B25C 5/15; B25C 1/008
See application file for complete search history.

(56) References Cited

U.S. PATENT DOCUMENTS 4,509,668 A * 4/1985 Klaus ..... B25C 1/008 D8/30
2018/0117748 A1 5/2018 Ishikawa et al.
(Continued)

FOREIGN PATENT DOCUMENTS

EP 0736360 A2 10/1996
EP 3461592 A1 4/2019
(Continued)

OTHER PUBLICATIONS

International Search Report and Written Opinion issued for PCT Application No. PCT/JP2019/007714 dated May 21, 2019, 6 pages.
(Continued)

*Primary Examiner* — Anna K Kinsaul
*Assistant Examiner* — Veronica Martin
(74) *Attorney, Agent, or Firm* — Weihrouch IP

(57) ABSTRACT

A driving tool includes a driving mechanism which is driven with a fluid and which is configured to drive a fastener supplied to a nose portion and a clocking mechanism configured to perform clocking of a time period for switching between presence and absence of actuation of the driving mechanism. The clocking mechanism is supplied with a fluid for actuating the driving mechanism, moves a moving member from an initial position to a clocking starting position where clocking is started by force of the fluid, and performs clocking by controlling movement of the moving member by applying a load of resistance when the moving member moves from the clocking starting position to the initial position thereof.

6 Claims, 8 Drawing Sheets

(51) Int. Cl.
*B25C 1/06* (2006.01)
*B25C 5/15* (2006.01)

(56) References Cited

U.S. PATENT DOCUMENTS

2019/0022842 A1 1/2019 Oouchi
2019/0389045 A1* 12/2019 Ishikawa ..... B25C 1/043

FOREIGN PATENT DOCUMENTS

JP 2016-179526 A 10/2016
WO 2017/115593 A1 7/2017

OTHER PUBLICATIONS

Extended European Search Report dated Dec. 3, 2021, issued by the European Patent Office in the corresponding European Patent Application No. 19761618.8. (8 pages).

* cited by examiner

FASTENER-DRIVING TOOL

CROSS REFERENCE TO RELATED APPLICATION

This application is a 35 U.S.C. 371 National Phase Entry Application from PCT/JP2019/007714, filed Feb. 27, 2019, which claims priority to Japanese Patent Application No. 2018-036898, filed Mar. 1, 2018, the disclosures of which are incorporated herein in their entirety by reference, and priority is claimed to each of the foregoing.

TECHNICAL FIELD

The present invention relates to a driving tool that is driven with a fluid, such as compressed air.

BACKGROUND ART

There is known a driving tool referred to as a nailing machine in which a driving piston is actuated by a driving mechanism using a fluid such as compressed air as a power source, and in which a driver coupled to the driving piston is driven to drive a fastener such as a nail supplied to a nose. In such a nailing machine, the driving mechanism is actuated by operations of two members to drive a nail, which are one operation of pulling a trigger provided on a handle and the other operation of pressing a contact arm, which protrudes at a tip end of the nose and is provided so as to be reciprocally movable, against an object.

In the following description, a state where the trigger is pulled by the one operation is referred to as "ON of the trigger", and a state where the one operation is released and the trigger is not pulled is referred to as "OFF of the trigger". In addition, a state where the contact arm is pressed by the other operation is referred to as "ON of the contact arm", and a state where the other operation is released and the contact arm is not pressed is referred to as "OFF of the contact arm".

In the nailing machine, for example, after the contact arm is set ON, the trigger is set ON with the contact arm in the ON state, so that the driving mechanism is actuated to perform nail driving.

The trigger and the contact arm are set OFF after the nail driving, and the trigger and the contact arm are set ON again as described above, so that the driving mechanism is actuated to perform a next nail driving. An operation in which the trigger and the contact arm are set ON for each nail driving after being set OFF to perform the next nail driving as described is referred to as "a single driving mode".

In contrast, there has been proposed a technique in which the contact arm is set OFF after the nail driving with the trigger in an ON state, and the contact arm is set ON again with the trigger in the ON state, so that the driving mechanism is actuated to perform the next nail driving. An operation in which continuous nail driving is performed by repeating ON and OFF of the contact arm with the trigger in the ON state as described is referred to as "a continuous driving mode".

In the continuous driving mode, the nail driving can be continuously performed each time the contact arm is pressed against the object after a nail driving with the trigger being pulled, and thus it is suitable for quick work. On the other hand, in the single driving mode, the operations of the trigger and the contact arm are released after a nail driving, and the trigger is pulled again after the contact arm is pressed against the object so as to perform the next nail driving; it is not suitable for quick work although an effect of regulating undesired operation is presented. Therefore, there has been proposed a technique in which, a continuous nail driving operation for a certain time period is made possible only by the operation of pressing the contact arm against the object, with the operation of the trigger not released after one time of nail driving is performed by pressing the contact arm against the object and then pulling the trigger (see, for example, Patent Literature 1).

CITATION LIST

Patent Literature

Patent Literature 1: JP-A-2016-179526

SUMMARY OF INVENTION

Technical Problem

In a configuration in which continuous driving of nails or the like can be performed only by the operation of pressing the contact arm against the object without releasing the operation of the trigger, control that enables the continuous driving operation for a certain time period is performed using an electric timer, so that clocking can be stably performed. However, a nailing machine driven by compressed air does not include a supply source of electricity. Therefore, in order to use an electric timer, a power supply and a circuit are required.

Alternatively, a configuration is conceivable in which a mechanical clocking mechanism is incorporated into the trigger. However, it is necessary to incorporate the mechanical clocking mechanism in a limited space, and it is difficult to stably perform clocking. If the clocking can not be performed stably, a time period during which the continuous driving operation is possible is not constant, and the operation feeling gets worse.

It is conceivable to use an oil damper as a mechanical clocking mechanism. The oil damper is a configuration of applying a load to movement of the piston by resistance of oil, in which if the piston is moved by a force of a spring, time required for the movement can be used for clocking, by reducing a moving speed of the piston with the force of the spring and keeping the moving speed of the piston constant.

In a configuration using the oil damper as a clocking mechanism, when an operation of pressing the contact arm against the object is transmitted to the oil damper and the oil damper is actuated, viscosity of the oil serves as a load, and an operating load of the contact arm increases. In addition, in a case of performing the continuous driving operation, the operating load increases for actuating the oil damper in a first operation of pressing the contact arm against the object. On the other hand, in a second operation and subsequent operations of pressing the contact arm against the object, the operating load decreases because an actuating load of the oil damper decreases. Such variation in the operating load leads to deterioration of operability. The same applies to a case where a load is applied by resistance due to friction or the like other than oil.

The present invention has been made in order to solve such a problem, and an object thereof is to provide a driving tool that is capable of stably switching between performing and not performing the continuous driving operation with a mechanical configuration without increasing the operating load.

Solution to Problem

In order to solve the problems described above, the present invention provides a driving tool including: a driving mechanism which is driven with a fluid and which is configured to drive a fastener supplied to a nose portion; and a clocking mechanism configured to perform clocking of a time period for switching between presence and absence of actuation of the driving mechanism, in which the clocking mechanism is supplied with a fluid for actuating the driving mechanism, moves a moving member from an initial position to a clocking starting position where clocking is started by force of the fluid, and performs clocking by controlling movement of the moving member by applying a load of resistance when the moving member moves from the clocking starting position to the initial position thereof.

In the present invention, when the fluid is supplied and the driving mechanism is actuated, a fluid for actuating the driving mechanism is supplied to the timing mechanism, the moving member moves to the clocking starting position, and clocking of a time period for switching between presence and absence of actuation of the driving mechanism is started.

After time for stopping the actuation of the driving mechanism elapses, the driving mechanism can be actuated by performing a predetermined operation.

Advantageous Effects of Invention

In the present invention, it is possible to stably perform clocking with a mechanical clocking mechanism, without increasing the operating load for actuating the mechanical clocking mechanism, and it is possible to switch the presence and absence of the actuation of the driving mechanism at a predetermined timing.

DESCRIPTION OF EMBODIMENTS

Hereinafter, an embodiment of a nailing machine, which is an example of a driving tool of the present invention, will be described with reference to the drawings.

<Configuration Example of Nailing Machine of First Embodiment>

Figure 1:
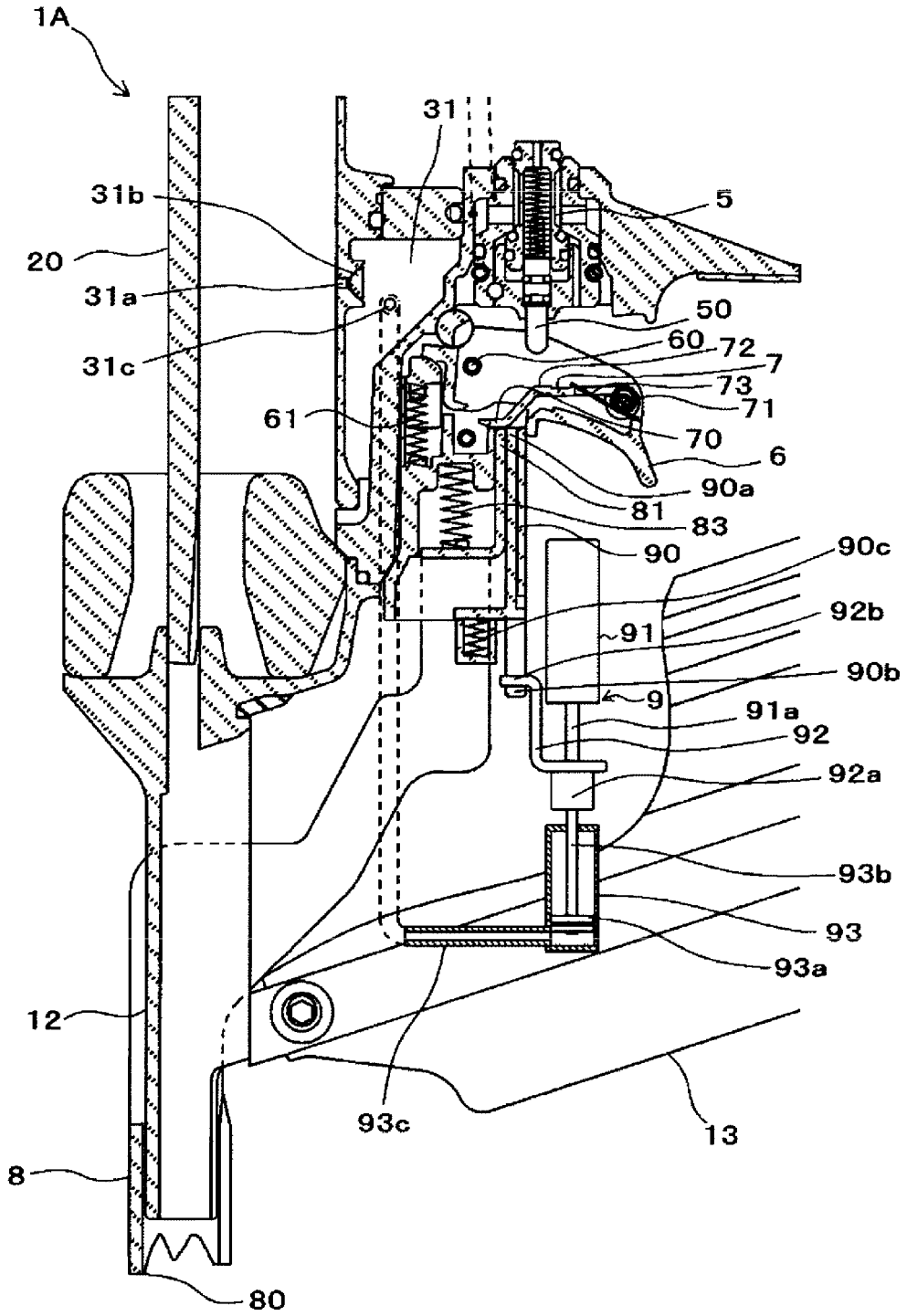
FIG. 1 is a main part configuration diagram illustrating an example of a nailing machine according to a first embodiment.
Figure 2:
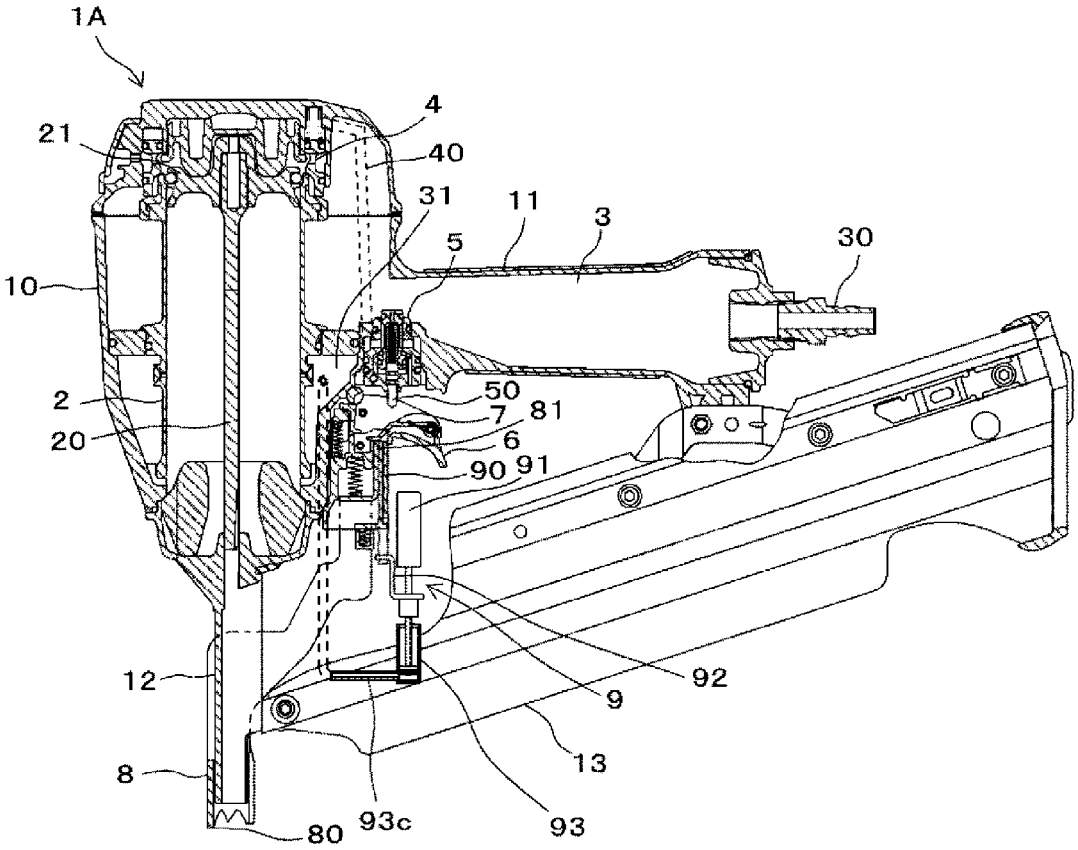
FIG. 2 is an overall configuration diagram illustrating the example of the nailing machine according to the first embodiment.

FIG. 1 is a main part configuration diagram illustrating an example of a nailing machine according to a first embodiment. FIG. 2 is an overall configuration diagram illustrating the example of the nailing machine of the first embodiment.

A nailing machine 1A according to the first embodiment includes a driving cylinder 2 that is actuated with compressed air serving as a fluid, which is a power source, to perform a striking operation, and an air chamber 3 in which compressed air supplied from an external air compressor (not illustrated) is stored. In the nailing machine 1A, the driving cylinder 2 is provided in an inner portion of a housing 10 having a shape extending in one direction, and the air chamber 3 is provided in an inner portion of a handle 11 extending from the housing 10 in another direction. In addition, in the nailing machine 1A, a blowback chamber 31 is provided around a lower portion of the driving cylinder 2 at the inner portion of the housing 10.

The driving cylinder 2, which is an example of a driving mechanism, includes a driver 20 drives a nail or the like (not illustrated), and a driving piston 21 provided with the driver 20. The driving piston 21 is slidably provided. In the driving cylinder 2, the driving piston 21 is moved by being pushed with compressed air to drive the driver 20.

The compressed air is supplied to the air chamber 3 from a compressed air source such as an air compressor through an air plug 30 provided at an end portion of the handle 11. The blowback chamber 31 is supplied with compressed air to drive and return the driving piston 21 after a driving operation to an initial position. The blowback chamber 31 is connected to the driving cylinder 2 via an inflow discharge port 31*a*. The inflow discharge port 31*a* includes a check valve 31*b* that regulates a flow direction of air to one direction. The check valve 31*b* allows air to flow from the driving cylinder 2 to the blowback chamber 31, and regulates a backflow of air from the blowback chamber 31 to the driving cylinder 2.

The nailing machine 1A includes, at one end portion of the housing 10, a nose 12 into which the driver 20 enters, and a magazine 13 that supplies a nail (not illustrated) to the nose 12. The nose 12 extends along a moving direction of the driver 20. In consideration of a use form of the nailing machine 1A, a side at which the nose 12 is provided is referred to as a lower direction.

The nailing machine 1A includes a main valve 4 that regulates inflow and outflow of compressed air in the air chamber 3 to cause the driving piston 21 to reciprocate, and a actuating valve 5 that actuates the main valve 4. The main valve 4 switches between inflow of compressed air from the air chamber 3 into the driving cylinder 2 and discharge of the compressed air from inside the driving cylinder 2 to an outside, so that the driving piston 21 is caused to reciprocate. The actuating valve 5 includes a valve stem 50 that is provided so as to be reciprocally movable, and the valve stem 50 is moved by a predetermined amount to open a flow path 40 to actuate the main valve 4.

The nailing machine 1A includes a trigger 6 that receives one operation for actuating the actuating valve 5, a contact arm 8 that moves in response to another operation to be pressed against an object to which a nail is hit, and a contact lever 7. The contact lever 7 is provided so as to be capable of being actuated by an operation of the trigger 6 having received the one operation and by an operation of the contact arm 8 having received the other operation, and switches between presence and absence of actuation of the actuating valve 5. Further, the nailing machine 1A includes a regulating part 9 that regulates movement, a moving speed, or a movement amount of the contact lever 7 for a predetermined time period, and that switches between presence and absence of actuation of the contact lever 7 depending on the contact arm 8, according to presence or absence of engagement between the contact lever 7 and the contact arm 8 in this example.

The trigger 6 is provided on one side of the handle 11 which is a side where the nose 12 is provided. One end portion side of the trigger 6, which is a side close to the housing 10, is rotatably supported by a shaft 60. Further, a side opposite the side supported by the shaft 60, that is, the other end portion side of the trigger 6 which is a side far from the housing 10, is biased by a spring 61 in a direction of moving toward a side where the nose 12 is provided, by a rotation operation using the shaft 60 as a fulcrum.

In this example, a moving range of the trigger 6 by the rotation operation using the shaft 60 as a fulcrum is regulated by bringing the trigger 6 abutting against an abutting portion formed in the housing 10 and the handle 11.

The contact lever 7 includes, at one end portion thereof, an engaging portion 70 with which the contact arm 8 can engage, and the other end portion thereof is rotatably supported by a shaft 71 on the trigger 6. A pushing portion 72 capable of pushing the valve stem 50 of the actuating valve 5 is provided between the engaging portion 70 and the shaft 71. Further, a side opposite the side supported by the shaft 71, that is, the one end portion side of the contact lever 7 where the engaging portion 70 is provided, is biased by a spring 73 such as a torsion coil spring in a direction of moving toward a side where the nose 12 is provided, by a rotation operation using the shaft 71 as a fulcrum.

The contact arm 8 is provided so as to be movable along an extension direction of the nose 12, and includes an abutting portion 80 that abuts against an object at a tip end side of the nose 12. The contact arm 8 includes a pushing portion 81 that actuates the contact lever 7. The contact arm 8 is biased by a spring 83 in a direction of protruding from the tip end side of the nose 12.

In a state where an operation is released, the trigger 6 is biased by the spring 61 to move to an initial position thereof by the rotation operation using the shaft 60 as a fulcrum. The trigger 6 is moved, by the rotation operation using the shaft 60 as a fulcrum according to a pulling operation, from the initial position to an operating position thereof where the actuating valve 5 can be actuated by the contact lever 7.

When pushed by the contact arm 8, the contact lever 7 is moved, by the rotation operation using the shaft 71 as a fulcrum, from an initial position thereof to a position where the driving cylinder 2 can be actuated in accordance with the position of the trigger 6, that is, to an actuation possible position in this example where the valve stem 50 can be pushed to actuate the actuating valve 5.

When the abutting portion 80 is pushed by being abutted against the object, the contact arm 8 moves from an initial position thereof to an actuating position thereof where the contact lever 7 is actuated by the pushing portion 81.

When the pushing portion 81 engages with the engaging portion 70 of the contact lever 7 by an operation of moving the contact arm 8 from the initial position thereof to the actuating position thereof, the contact lever 7 is actuated by the operation of the contact arm 8, and the contact lever 7 is moved from the initial position thereof to the actuation possible position thereof. In addition, with respect to the contact arm 8, the presence and absence of engagement between the engaging portion 70 of the contact lever 7 and the pushing portion 81 of the contact arm 8 are switched in accordance with the position of the trigger 6 and the position of the contact lever 7.

That is, when the trigger 6 is operated, the contact lever 7 moves together with the trigger 6 by the rotation operation of the trigger 6 using the shaft 60 as a fulcrum. Accordingly, the initial position and the actuation possible position of the contact lever 7 are relative positions that change in accordance with the position of the trigger 6, and the positions of the engaging portion 70 and the pushing portion 72 of the contact lever 7 vary depending on whether the trigger 6 is in the initial position thereof or the operating position thereof.

In a state where the trigger 6 and the contact lever 7 are moved to respective initial positions, the pushing portion 72 of the contact lever 7 does not contact the valve stem 50 of the actuating valve 5. In addition, in a state where the contact lever 7 is moved to the initial position thereof, the pushing portion 72 of the contact lever 7 does not contact the valve stem 50 of the actuating valve 5 even if the trigger 6 moves to the operating position thereof.

In contrast, when the contact arm 8 moves to the actuating position thereof in a state where the trigger 6 is moved to the initial position thereof, the pushing portion 81 of the contact arm 8 engages with the engaging portion 70 of the contact lever 7, and the contact lever 7 moves to the actuation possible position thereof. Accordingly, when the trigger 6 moves to the operating position thereof, the pushing portion 72 of the contact lever 7 can push the valve stem 50 of the actuating valve 5, and the actuating valve 5 can be actuated by the contact lever 7.

On the other hand, when the trigger 6 moves to the operating position thereof in a state where the contact arm 8 is moved to the initial position thereof, the pushing portion 81 cannot engage with the engaging portion 70 of the contact lever 7 even if the contact arm 8 moves, and the pushing portion 72 of the contact lever 7 cannot push the valve stem 50 of the actuating valve 5 even if the trigger 6 moves to the operating position thereof.

Accordingly, even if the trigger 6 is operated first and the contact arm 8 is operated next, the actuating valve 5 cannot be actuated, and continuous driving by an operation of pushing the contact arm 8 against an object cannot be performed. In the present embodiment, since the regulating part 9 is provided, when the contact arm 8 is operated first and the trigger 6 is operated next, the continuous driving can be performed in accordance with the presence and absence of the operation of the contact arm 8 for a predetermined time period.

The regulating part 9 includes a regulating member 90 that regulates a position of the contact lever 7 to an actuation standby position where the contact lever 7 can be actuated by the contact arm 8. In addition, the regulating part 9 includes an oil damper 91 that maintains a state for a predetermined time period where the contact lever 7 is in the actuation standby position.

The actuation standby position of the contact lever 7 is a position or a range where the contact lever 7 can engage with the contact arm 8, and the contact lever 7 can be actuated by the contact arm 8 while the contact lever 7 is in this position or range. In the following description, the actuation standby position is referred to as an engagement possible position.

The regulating member 90 is provided so as to be movable along a moving direction of the contact arm 8, and includes, at one end portion along the moving direction, a pushing portion **90*a* that pushes the contact lever 7. The regulating member 90 is provided with the pushing portion 90*a* thereof adjacent to the pushing portion 81 of the contact arm 8. In addition, the regulating member 90 includes an engaged portion 90*b* that can engage with the oil damper 91**.

The regulating member 90 is biased by a spring **90*c* in a direction in which the pushing portion 90*a* approaches the contact lever 7**.

Further, the regulating member 90 moves from an initial position thereof where the pushing portion 90*a* does not contact the contact lever 7 to a return regulating position for regulating the position of the contact lever 7 to an engagement possible position where the contact lever 7 and the contact arm 8 can engage with each other. The return regulating position of the regulating member 90 is a position where, by an operation of that the regulating member 90 moves by being pushed by the spring 90*c*, the pushing portion 90*a* protrudes relative to the pushing portion 81 and the pushing portion 90*a* can contact the engaging portion 70 of the contact lever 7 in a state where the contact arm 8 is moved to the initial position thereof.

The oil damper 91 is an example of a clocking mechanism, and a piston shaft portion 91*a* is coupled to a piston (not illustrated) whose moving speed is controlled by resistance due to viscosity of oil or the like. The oil damper 91 includes a moving member 92 that moves the regulating member 90, and controls movement, a moving speed, or a movement amount of the moving member 92. In this example, the oil damper 91 controls the moving speed of the moving member 92. The moving member 92 is provided so as to be movable along a moving direction of the regulating member 90, and includes a pushed portion 92*a* coupled to the piston shaft portion 91*a* and an engaging portion 92*b* that engages with the engaged portion 90*b* of the regulating member 90.

The oil damper 91 moves the moving member 92 from an initial position thereof where the regulating member 90 is moved to the initial position thereof, to a clocking starting position for starting clocking a time period during which the movement of the contact lever 7 moved to the engagement possible position thereof after an operation of the contact arm 8 is released is regulated, that is, a time period until the regulating member 90, which is moved to the return regulating position, moving to the initial position thereof in this example.

The regulating member 90 is provided with the engaged portion 90*b* in a moving path of the engaging portion 92*b* which is formed due to the movement of the moving member 92. By an operation of moving the moving member 92 of the oil damper 91 from the initial position thereof to the clocking starting position thereof, the engagement between the engaging portion 92*b* of the moving member 92 and the engaged portion 90*b* of the regulating member 90 is released. Accordingly, the regulating member 90 is pushed by the spring 90*c* to move from the initial position thereof to the return regulating position thereof.

In addition, by an operation of moving the moving member 92 of the oil damper 91 from the clocking starting position thereof to the initial position thereof, the engaging portion 92*b* of the moving member 92 and the engaged portion 90*b* of the regulating member 90 engage with each other. Accordingly, the regulating member 90 moves from the return regulating position thereof to the initial position thereof.

The oil damper 91 is actuated with compressed air that is a power source of the nailing machine 1A. Accordingly, an air cylinder 93 actuated with compressed air is provided. The air cylinder 93 includes an air piston 93*a* that is pushed by compressed air to move, and a piston shaft portion 93*b* coupled to the air piston 93*a*. The piston shaft portion 93*b* of the air cylinder 93 is coupled to the pushed portion 92*a* of the moving member 92.

In this example, compressed air is supplied to the air cylinder 93 from the blowback chamber 31. Therefore, an actuating air flow path 93*c* connected to a discharge port 31*c* of the blowback chamber 31 is provided between the blowback chamber 31 and the air cylinder 93. When compressed air is supplied to the blowback chamber 31 in a driving operation to be described below, a part of the compressed air is supplied from the discharge port 31*c*, through the actuating air flow path 93*c*, to the air cylinder 93. Accordingly, the air piston 93*a* is pushed, and the oil damper 91 and the moving member 92 are actuated via the piston shaft portion 93*b*.

Accordingly, a time period during which the moving member 92 moves from the clocking starting position thereof to the initial position thereof is controlled, and a time period during which the regulating member 90 moves from the return regulating position thereof to the initial position thereof is controlled. Therefore, with respect to the contact lever 7 having moved to the engagement possible position thereof by an operation of moving the contact arm 8 toward the initial position thereof, a time period until returning to the initial position thereof is controlled by operations of the regulating member 90 and the moving member 92.

<Operation Example of Nailing Machine of First Embodiment>

FIGS. 3 to 8 are illustrative diagrams illustrating examples of operations of the nailing machine according to the first embodiment. The operations of the nailing machine 1A according to the first embodiment will be described below with reference to the drawings.

In an initial state, as illustrated in FIG. 1, the trigger 6 is not pulled and is in the initial position thereof, and the contact arm 8 is not pressed against the object and is in the initial position thereof. Therefore, the contact lever 7, the regulating member 90, and the moving member 92 are also in respective initial positions.

In an initial state where the trigger 6 is in the initial position thereof and the contact lever 7 is in the initial position thereof, the engaging portion 70 of the contact lever 7 is positioned in a moving path of the pushing portion 81 of the contact arm 8.

Figure 3:
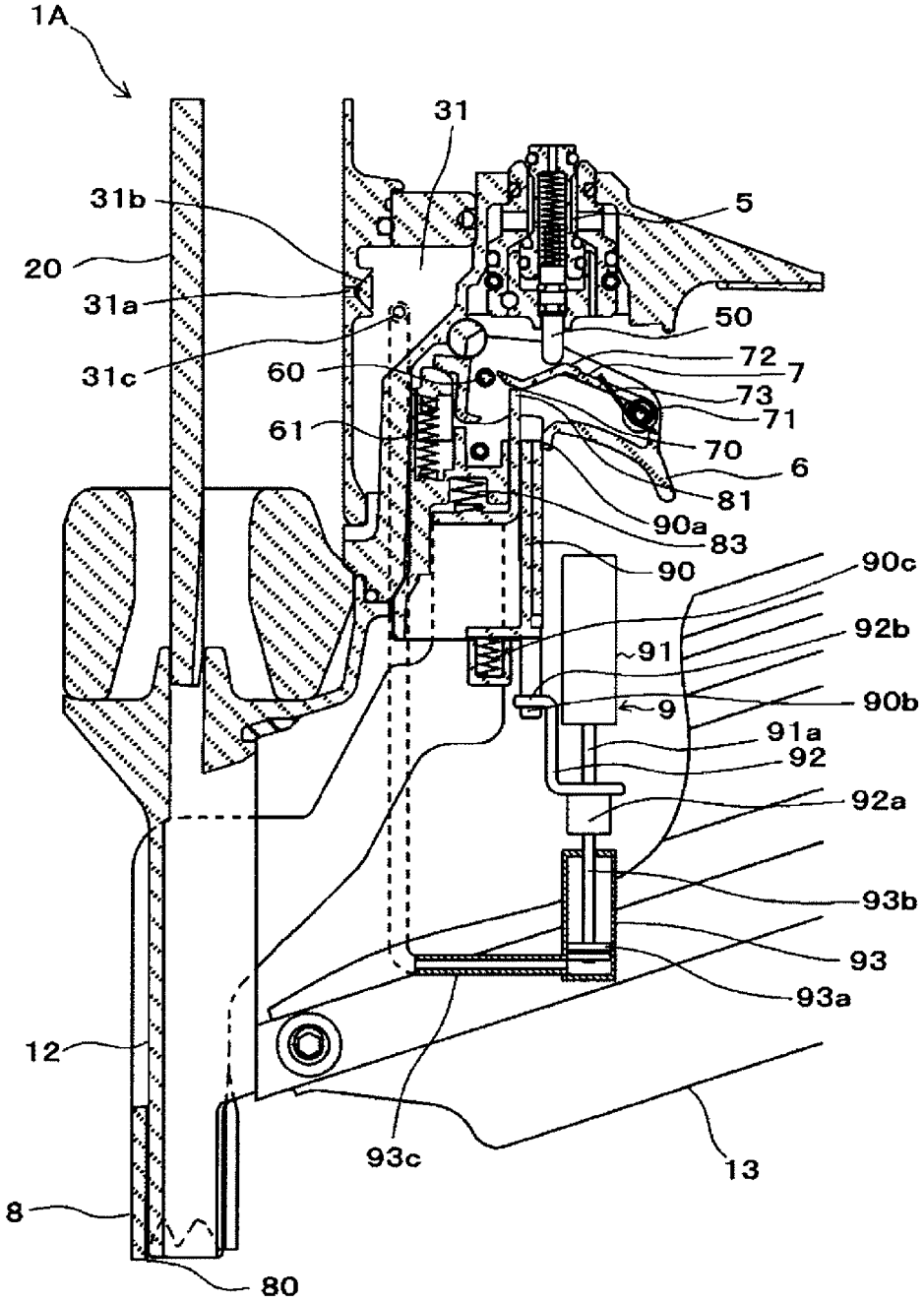
FIG. 3 is an illustrative diagram illustrating an example of an operation of the nailing machine according to the first embodiment.

When the contact arm 8 moves from the initial position thereof to the actuating position thereof by being pressed against the object, starting from the initial state illustrated in FIG. 1, the pushing portion 81 of the contact arm 8 pushes the engaging portion 70 of the contact lever 7 as illustrated in FIG. 3. Accordingly, by the rotation operation using the shaft 71 as a fulcrum, the contact lever 7 moves from the initial position thereof to the actuation possible position thereof where the valve stem 50 of the actuating valve 5 can be pushed to actuate the actuating valve 5. Not that even if the contact lever 7 moves to the actuation possible position thereof, the valve stem 50 cannot be pushed by the contact lever 7 unless the trigger 6 moves to the operating position thereof.

Figure 4:
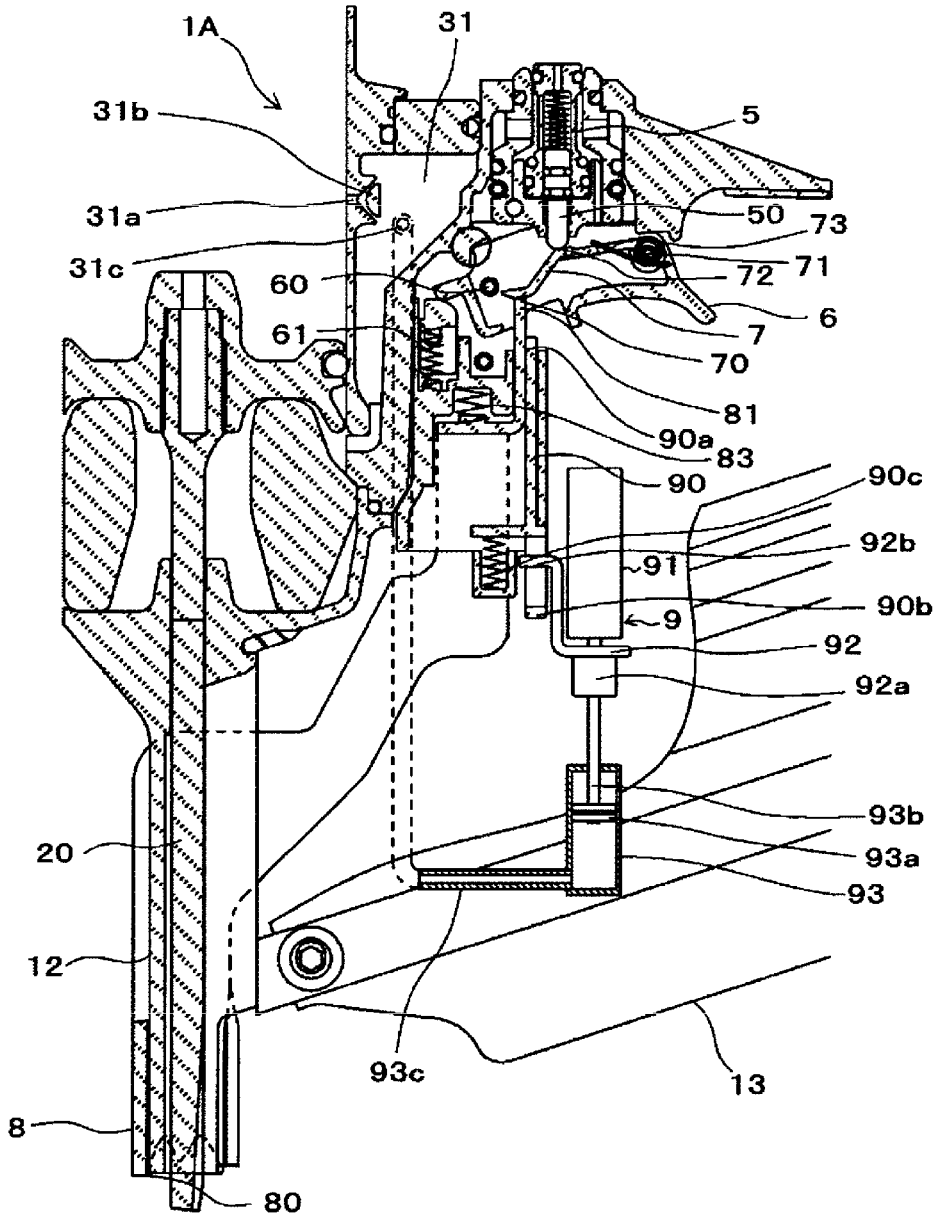
FIG. 4 is an illustrative diagram illustrating an example of an operation of the nailing machine according to the first embodiment.

When the trigger 6 is pulled to be moved from the initial position thereof to the operating position thereof after the contact arm 8 moves to the actuating position thereof by being pressed against the object from the initial state, as illustrated in FIG. 4, the pushing portion 72 of the contact lever 7 in the actuation possible position thereof pushes the valve stem 50 of the actuating valve 5. Accordingly, the main valve 4 is controlled to actuate the driving cylinder 2 with compressed air, the driving piston 21 moves in a direction in which a fastener (not illustrated), which is a nail in this example, is driven, and a driving operation of the nail (not illustrated) is performed with the driver 20. In addition, a part of the air in the driving cylinder 2 is supplied to the blowback chamber 31 from the inflow discharge port 31*a*. After the driving operation, the compressed air is supplied from the blowback chamber 31 to the driving cylinder 2, and the driving piston 21 moves in a direction in which the driver 20 is returned.

Further, a part of the compressed air supplied to the blowback chamber 31 is supplied to the air cylinder 93 through the actuating air flow path 93*c*. Accordingly, the air piston 93*a* is pushed to actuate the oil damper 91 and the moving member 92 via the piston shaft portion 93*b*, and the moving member 92 moves from the initial position thereof to the clocking starting position thereof. In addition, when the moving member 92 moves to the clocking starting position thereof, the engagement between the engaging portion 92*b* of the moving member 92 and the engaged portion 90*b* of the regulating member 90 is released, and the regulating member 90 is pushed by the spring 90*c* to move from the initial position thereof to the return regulating position thereof.

Figure 5:
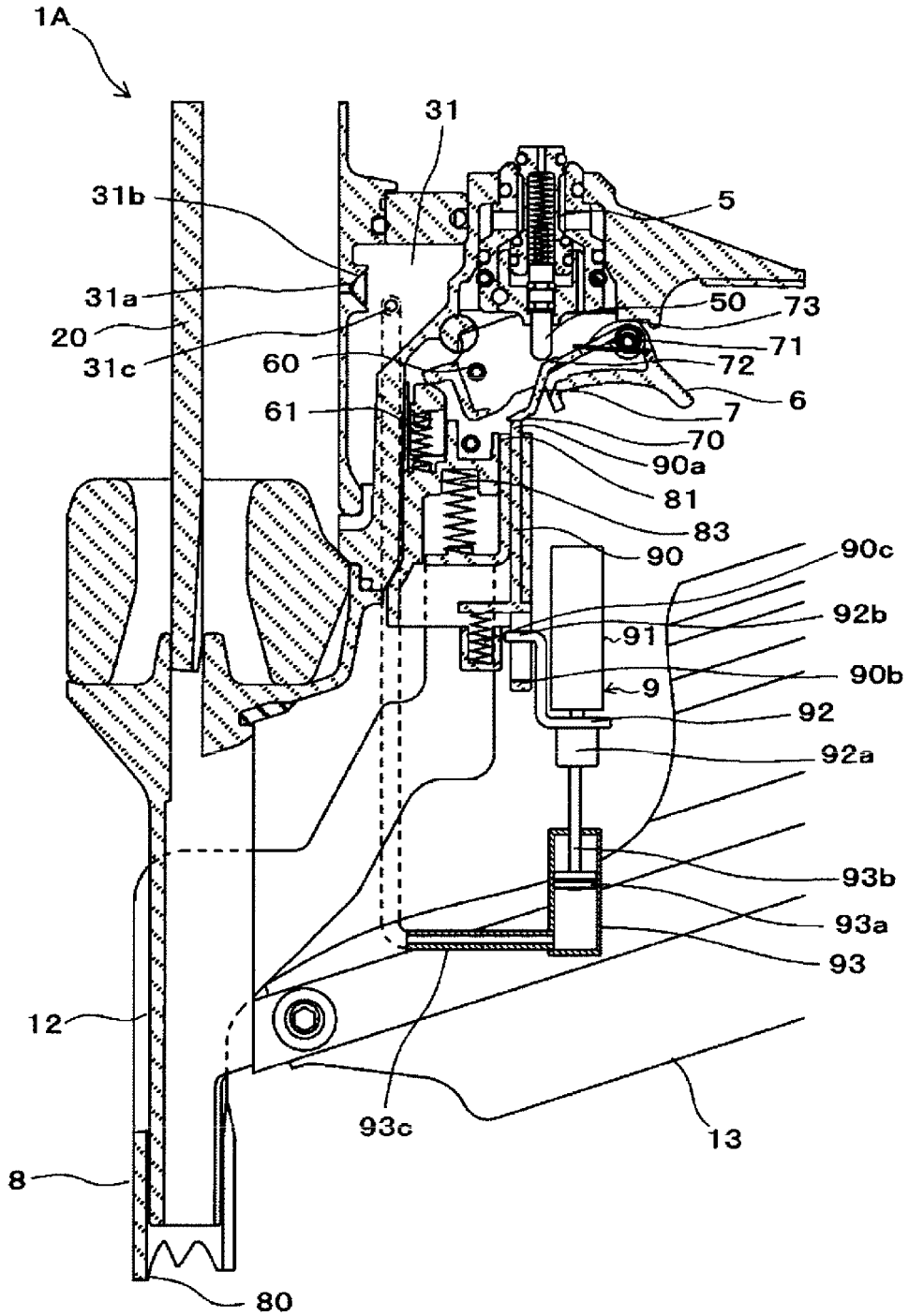
FIG. 5 is an illustrative diagram illustrating an example of an operation of the nailing machine according to the first embodiment.

While the trigger 6 is at the operating position and in a pulled state after the driving operation, the contact arm 8 moves from the actuating position thereof to the initial position thereof under the force of the spring 83 as illustrated in FIG. 5, by releasing a force of pressing the contact arm 8.

When the contact arm 8 moves to the initial position thereof, the pushing against the contact lever 7 by the pushing portion 81 is released, and the contact lever 7 starts moving in a direction of returning from the actuation possible position thereof toward the initial position thereof by the rotation operation using the shaft 71 as a fulcrum by a force of the spring 73.

The regulating member 90 that is moved to the return regulating position regulates the movement of the contact lever 7 that moves in the direction of returning from the actuation possible position thereof toward the initial position thereof, with the pushing portion 90*a* positioned on a movement path of the contact lever 7.

Accordingly, when the contact arm 8 moves to the initial position thereof, the contact lever 7 moves to come into contact with the pushing portion 90*a* of the regulating member 90 and stops at the engagement possible position thereof. Further, the contact lever 7 having moved to the engagement possible position thereof has the engaging portion 70 thereof positioned on a movement path of the pushing portion 81 of the contact arm 8.

When supply of the compressed air from the driving cylinder 2 to the blowback chamber 31 is completed, the moving member 92 starts moving in a direction of returning from the clocking starting position thereof to the initial position thereof by a force of a spring (not illustrated) of the oil damper 91.

Figure 6:
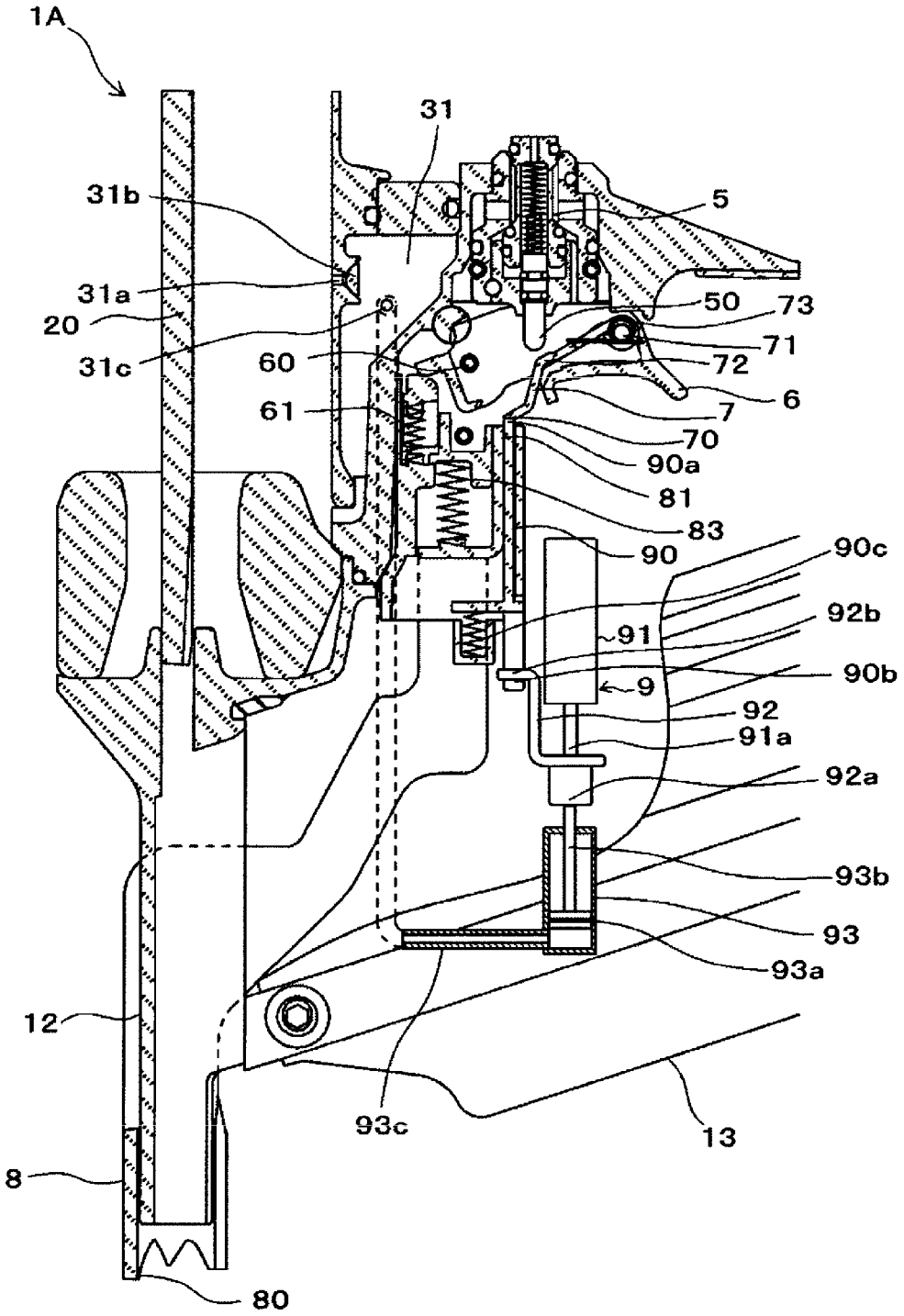
FIG. 6 is an illustrative diagram illustrating an example of an operation of the nailing machine according to the first embodiment.

The moving member 92 is moved from the clocking starting position thereof to the initial position thereof by a force of a spring (not illustrated), but the moving speed of the moving member 92 is controlled with the resistance due to the viscosity of the oil or the like. Accordingly, the time period during which the moving member 92 moves from the clocking starting position thereof to the initial position thereof is controlled, and during a predetermined time period until the moving member 92 moving to the initial position thereof, the engaging portion 92*b* of the moving member 92 and the engaged portion 90*b* of the regulating member 90 are in an unengaged state, and the regulating member 90 stops at the return regulating position thereof, as illustrated in FIG. 6.

Therefore, the contact lever 7 stops at the engagement possible position thereof and the engaging portion 70 is positioned on the movement path of the pushing portion 81 of the contact arm 8 during the predetermined time period in which the moving member 92 moves from the clocking starting position thereof to the initial position thereof, that is, during the time period in which the engaging portion 92*b* of the moving member 92 and the engaged portion 90*b* of the regulating member 90 are in an unengaged state.

Accordingly, when the contact arm 8 having moved to the initial position thereof moves from the initial position thereof to the actuating position thereof again by being pressed against the object before the predetermined time period in which the moving member 92 moves from the clocking starting position thereof to the initial position thereof elapses, with the trigger 6 being in the operating position thereof and in a pulled state, the pushing portion 81 of the contact arm 8 can push the engaging portion 70 of the contact lever 7.

Therefore, when the contact arm 8 having moved to the initial position thereof is moved to the actuating position thereof again within the predetermined time period, with the trigger 6 being in the operating position thereof and in a pulled state, the engaging portion 70 of the contact lever 7 is pushed by the pushing portion 81 of the contact arm 8, the contact lever 7 moves to the actuation possible position thereof, and the pushing portion 72 pushes the valve stem 50 of the actuating valve 4, as illustrated in FIG. 4.

Therefore, a continuous driving operation can be performed by an operation of pressing the contact arm 8 against the object during the predetermined period time, with the trigger 6 being in the operating position thereof and in a pulled state.

In contrast, when the predetermined time period elapses since the contact arm 8 moves to the initial position thereof, with the trigger 6 being in the operating position thereof and in a pulled state, the moving member 92 moves to the initial position thereof due to the oil damper 91.

Figure 7:
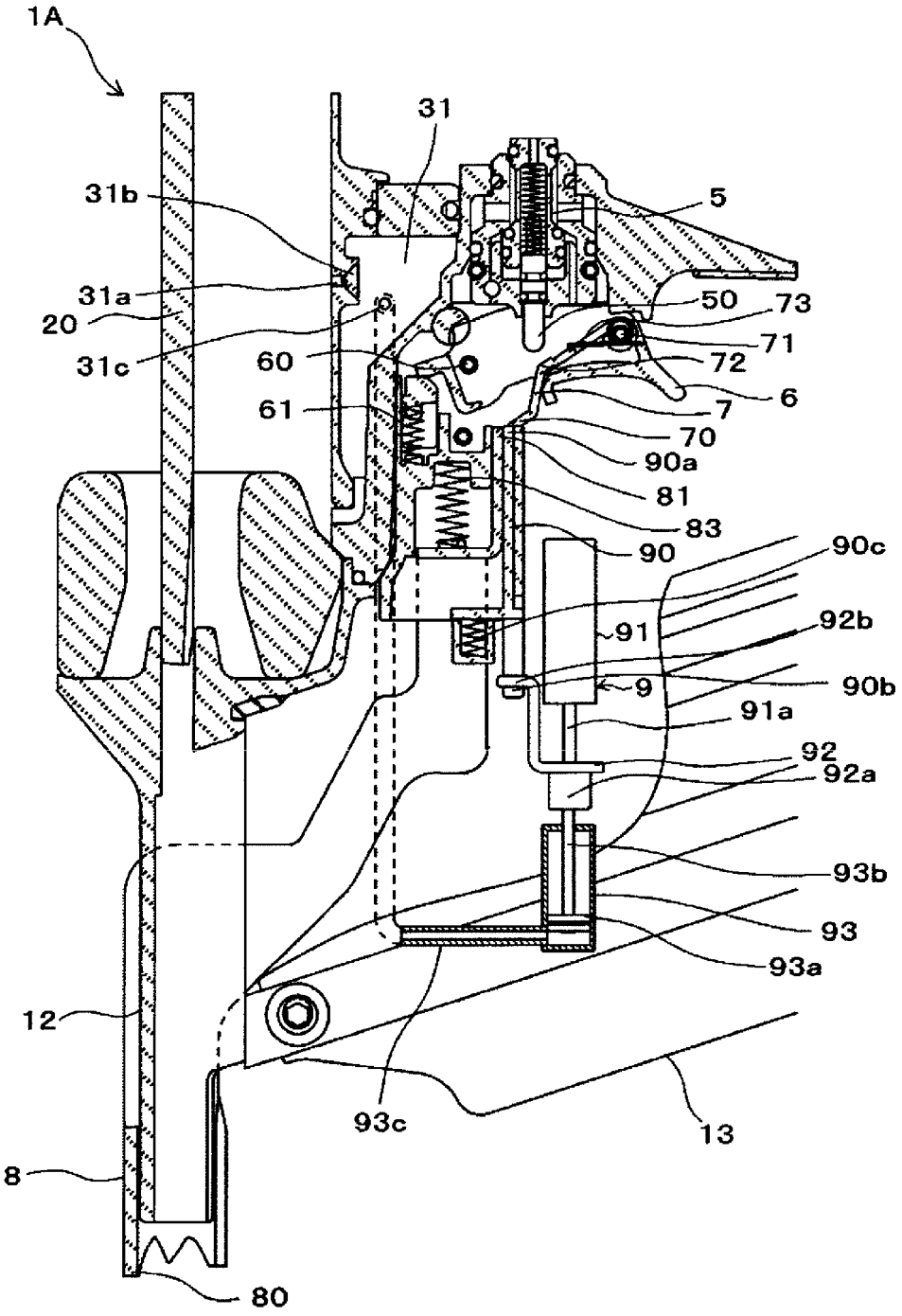
FIG. 7 is an illustrative diagram illustrating an example of an operation of the nailing machine according to the first embodiment.

When the moving member 92 moves to the initial position thereof, as illustrated in FIG. 7, the engaging portion 92*b* of the moving member 92 and the engaged portion 90*b* of the regulating member 90 are engaged. Accordingly, the regulating member 90 moves from the return regulating position thereof to the initial position thereof by being pressed by the moving member 92 that is moved by the oil damper 91.

When the regulating member 90 moves to the initial position thereof, the contact lever 7 moves from the engagement possible position to the initial position thereof, by the rotation operation using the shaft 71 as a fulcrum by the spring 73, in a case where the trigger 6 is in the operating position thereof. When the contact lever 7 moves to the initial position thereof with the trigger 6 in the operating position thereof, the engaging portion 70 of the contact lever 7 is retracted from the moving path of the pushing portion 81 of the contact arm 8.

Figure 8:
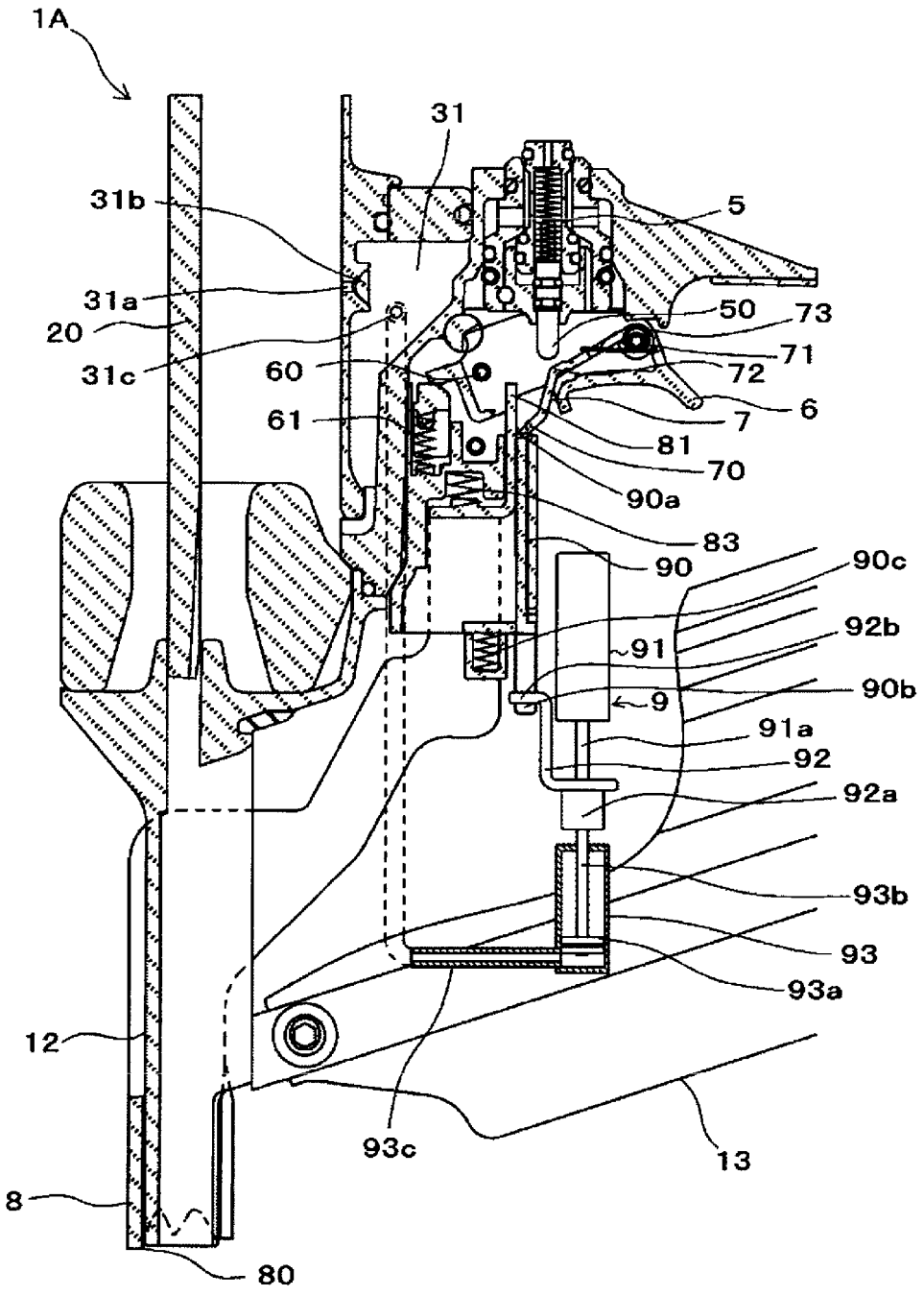
FIG. 8 is an illustrative diagram illustrating an example of an operation of the nailing machine according to the first embodiment.

Accordingly, when the predetermined time period elapses since the contact arm 8 moves to the initial position thereof, with the trigger 6 being in the operating position thereof and in a pulled state, even when the contact arm 8 moves to the actuating position thereof by the operation of pressing the contact arm 8 against the object, the pushing portion 81 of the contact arm 8 does not contact the engaging portion 70 of the contact lever 7 and the contact lever 7 is not pushed, as illustrated in FIG. 8.

Therefore, the actuating valve 5 is not pushed by the contact lever 7, and the driving operation is not performed. Therefore, the continuous driving operation by pressing the contact arm 8 against the object, with the trigger 6 being in the operating position thereof and in a pulled state, can be regulated by lapse of time using a mechanical configuration.

As described above, when the predetermined time period elapses since the driving operation completes, the contact lever 7 moves to the initial position thereof. After the contact lever 7 moves to the initial position thereof, the contact arm 8 is moved to the initial position thereof by releasing the force of pressing the contact arm 8. In addition, the trigger 6 moves to the initial position thereof by releasing the force of pulling the trigger 6. Accordingly, the initial state as illustrated in FIG. 1 is recovered. In the initial state, the engaging portion 70 of the contact lever 7 moves to the moving path of the pushing portion 81 of the contact arm 8.

Accordingly, when the trigger 6 moves to the operating position there by being pulled as illustrated in FIG. 4 after the contact arm 8 moves to the actuating position thereof by the operation of being pressed against the object as illustrated in FIG. 3, the valve stem 50 of the actuating valve 5 is pushed by the contact lever 7 that is moved to the actuation possible position thereof, and the driving operation is performed.

When the trigger 6 moves to the operating position thereof by being pulled before the contact arm 8 is pressed against the object from the initial state illustrated in FIG. 1, the engaging portion 70 of the contact lever 7 is retracted from the moving path of the pushing portion 81 of the contact arm 8.

Accordingly, after the trigger 6 is in the operating position thereof and in a pulled state from the initial state, the pushing portion 81 of the contact arm 8 does not contact the engaging portion 70 of the contact lever 7 and the contact lever 7 is not pushed, even when the contact arm 8 moves to the actuating position thereof by the operation of being pressed against the object.

Therefore, the valve stem 50 of the actuating valve 5 is not pushed by the contact lever 7, and the driving operation is not performed. Therefore, it is possible to regulate a driving operation that is by an operation other than an operation of a normal procedure of pressing the contact arm 8 against the object before pulling the trigger 6.

<Effect Example of Nailing Machine of First Embodiment>

The oil damper 91 is provided to reduce the moving speed of the moving member 92 in the operation of moving from the clocking starting position thereof to the initial position thereof, and provides the load with the viscosity of the oil. Therefore, in a case of a configuration in which the operation of pressing the contact arm 8 against the object is transmitted to the moving member 92 and the moving member 92 moves from the initial position thereof to the clocking starting position thereof, the viscosity of the oil serves as a load, and the operating load of the contact arm 8 increases. In addition, it is necessary to adjust a movement amount of the oil damper 91 to the movement amount of the contact arm 8, and it is limited to ensure the movement amount of the oil damper 91 required for clocking. Further, in a case of a configuration in which the operation of the contact arm 8 is transmitted to the moving member 92 and the moving member 92 is moved to the clocking starting position thereof by the operation of the contact arm 8, the clocking is started even if an actual driving operation is not performed, and since the continuous driving operation is possible, an undesired driving operation may be performed.

Therefore, the oil damper 91 and the moving member 92 are actuated with compressed air that is a power source of the nailing machine 1A. In this example, the air cylinder 93 to which compressed air is supplied from the blowback chamber 31 is provided, and the oil damper 91 and the moving member 92 are actuated by the air cylinder 93.

Accordingly, the mechanical clocking mechanism can be actuated without increasing the operating load of the contact arm 8. Further, regardless of the movement amount of the contact arm 8, it is possible to set the movement amount of the oil damper 91 required for clocking. Further, since the oil damper 91 and the moving member 92 are actuated when the compressed air is supplied from the driving cylinder 2 to the blowback chamber 31 by actuation of the driver 20, the clocking is started by performing an actual driving operation, and the continuous driving operation is possible. Therefore, if the actual driving operation is not performed, the continuous driving operation is not possible, and it is possible to reliably regulate the undesired driving operation. The compressed air is supplied from the blowback chamber 31 to the air cylinder 93 in this example, and alternatively may be supplied from the driving cylinder 2. In addition, the compressed air may be supplied to the air cylinder 93 by operating the actuating valve 5, compressed air for actuating the main valve 4 may be supplied to the air cylinder 93 by operating the start valve 5, and a part of the compressed air supplied from the air chamber 3 to the driving cylinder 2 may be supplied to the air cylinder 93 by operating the actuating valve 5 and actuating the main valve 4. Further, the clocking mechanism is the oil damper 91 that applies a load to the movement of the moving member 92 by resistance due to the viscosity of the oil or the like, and the present invention is not limited thereto. For example, the clocking mechanism may be a damper that is obtained by filling and enclosing a liquid different from oil in a cylinder and applies a load to the movement of the moving member 92 by resistance of the liquid, a damper obtained by filling and enclosing a gas such as nitrogen gas in a cylinder instead of oil, or a damper having a configuration of controlling inflow of gas into a cylinder and outflow of the gas from inside the cylinder. Alternatively, a friction damper that applies a load to the movement of the moving member 92 by resistance due to friction may be used.

In the embodiment described above, a nailing machine that drives a nail is described as an example of the driving tool of the present invention, and the present invention is not limited thereto. The present invention is also applicable to, for example, a screw driving machine that drives a screw.

This application is based on Japanese Patent Application No. 2018-036898 filed on Mar. 1, 2018, the contents of which are incorporated herein by reference.

REFERENCE SIGNS LIST

1A nailing machine (driving tool); 10 housing; 11 handle; 12 nose; 13 magazine; 2 driving cylinder (driving mechanism); 20 driver; 21 driving piston; 3 air chamber; 30 air plug; 31 blowback chamber; 31*a* inflow discharge port; 31*b* check valve; 31*c* discharge port; 4 main valve; 5 actuating valve; 50 valve stem; 6 trigger; 60 shaft; 61 spring; 7 contact lever; 70 engaging portion; 71 shaft; 72 pushing portion; 73 spring; 8 contact arm; 80 abutting portion; 81 pushing portion; 83 spring; 9 regulating part; 90 regulating member; 90*a* pushing portion; 90*b* engaged portion; 90*c* spring; 91 oil damper; 92 moving member; 92*a* pushed portion; 92*b* engaging portion; 93 air cylinder; 93*a* air piston; 93*b* piston shaft portion; 93*c* actuating air flow path

The invention claimed is:

1. A driving tool comprising:

a driving mechanism which is driven with compressed air and which is configured to drive a fastener supplied to a nose portion; and a clocking mechanism configured to perform clocking of a time period for switching between performing and not performing a continuous driving operation of the driving mechanism, wherein the driving mechanism comprises:

a driving cylinder having a driving piston actuated by being supplied with the compressed air; and a blowback chamber configured to retain the compressed air supplied from the driving cylinder for returning the driving piston, wherein the driving piston is moved from an initial position in a driving direction by compressed air supplied to the driving cylinder to drive the fastener, and wherein after driving the fastener the driving piston is returned to the initial position with compressed air from the blowback chamber, and the clocking mechanism is configured to:

move a moving member from an initial position to a clocking starting position where clocking is started, in response to movement of an air piston which is transmitted to the clocking mechanism, the air piston being actuated by the compressed air supplied from the blowback chamber; and perform clocking by controlling movement of the moving member by applying a load of resistance when the moving member moves from the clocking starting position to the initial position thereof, wherein the blowback chamber supplies compressed air both to: (1) return the driving piston to the initial position, and (2) actuate the air piston to move the moving member from the initial position to the clocking starting position.

2. The driving tool according to claim 1, wherein the driving tool comprises an air cylinder having the air piston therein.

3. The driving tool according to claim 1, wherein the clocking mechanism is an oil damper configured to apply, by resistance of oil, a load when the moving member moves.

4. The driving tool according to claim 1, wherein the blowback chamber includes an inflow discharge port through which compressed air from the driving cylinder enters the blowback chamber, and an actuating air flow path extends from the blowback chamber to the air piston to actuate the air piston.

5. The driving tool according to claim 2, wherein the blowback chamber includes an inflow discharge port through which compressed air from the driving cylinder enters the blowback chamber, and an actuating air flow path extends from the blowback chamber to the air cylinder to actuate the air piston in the air cylinder.

6. The driving tool according to claim 5, wherein a piston shaft is coupled to the air piston, and the piston shaft pushes a pushed portion of the moving member to move the moving member upon actuation of the air piston.

* * * * *